US007150671B2

(12) United States Patent
Maleika

(10) Patent No.: US 7,150,671 B2
(45) Date of Patent: Dec. 19, 2006

(54) TOY VEHICLE

(75) Inventor: Hubertus Maleika, Zirndorf (DE)

(73) Assignee: Stadlbauer Spie-Und Freizeitartikel GmbH, Nurnberg (DE)

( * ) Notice: Subject to any disclaimer, the term of this patent is extended or adjusted under 35 U.S.C. 154(b) by 142 days.

(21) Appl. No.: 10/466,064

(22) PCT Filed: Dec. 27, 2001

(86) PCT No.: PCT/DE01/04958

§ 371 (c)(1),
(2), (4) Date: Dec. 23, 2003

(87) PCT Pub. No.: WO02/055166

PCT Pub. Date: Jul. 18, 2002

(65) Prior Publication Data

US 2004/0082267 A1 Apr. 29, 2004

(30) Foreign Application Priority Data

Jan. 11, 2001 (DE) ..... 201 00 473 U
Jun. 5, 2001 (DE) ..... 201 09 329 U

(51) Int. Cl.
*A63H 29/02* (2006.01)
*A63H 29/22* (2006.01)

(52) U.S. Cl. ..... 446/462; 446/448; 446/457; 446/465; 74/354

(58) Field of Classification Search ..... 446/457, 446/458, 465, 448, 449, 443, 456, 460–463; 74/319, 353, 354, 352
See application file for complete search history.

(56) References Cited

U.S. PATENT DOCUMENTS

| | | | | | |
|---|---|---|---|---|---|
| 2,182,529 | A | * | 12/1939 | Wyrick | 446/461 |
| 2,218,513 | A | * | 10/1940 | Berger | 446/461 |
| 3,540,152 | A | * | 11/1970 | Hartling et al. | 446/433 |
| 3,564,935 | A | * | 2/1971 | Vingeri | 74/354 |
| 3,981,098 | A | * | 9/1976 | Darda | 446/464 |
| 4,112,615 | A | * | 9/1978 | Ishimoto | 446/456 |
| 4,387,604 | A | * | 6/1983 | Maher | 74/354 |
| 4,547,174 | A | * | 10/1985 | Lee et al. | 446/463 |
| 4,565,538 | A | * | 1/1986 | Kennedy et al. | 446/427 |
| 4,577,528 | A | * | 3/1986 | Hanzawa | 74/665 GA |
| 4,579,544 | A | * | 4/1986 | Matsushiro | 446/427 |
| 4,580,994 | A | * | 4/1986 | Fauser et al. | 446/465 |
| 4,582,171 | A | * | 4/1986 | Jezierski | 185/39 |
| 4,652,247 | A | * | 3/1987 | Goldfarb et al. | 446/164 |
| 4,655,724 | A | * | 4/1987 | Law | 446/443 |
| 5,273,480 | A | * | 12/1993 | Suto | 466/456 |
| 5,374,213 | A | * | 12/1994 | Brovelli | 446/463 |
| 5,429,543 | A | * | 7/1995 | Tilbor et al. | 446/456 |

(Continued)

FOREIGN PATENT DOCUMENTS

GB 2016645 A * 9/1979

*Primary Examiner*—Bena Miller
(74) *Attorney, Agent, or Firm*—Lowe, Hauptman & Berner LLP

(57) ABSTRACT

The invention relates to a toy vehicle, particularly for track-guided car racing circuits, that comprises a drive motor (10), which has a drive shaft (12), and comprises a driven axle (14), which is provided with wheels. A transmission (16) is mounted between the drive shaft (12) and the driven axle (14), and the transmission (16) is provided in the form of a manual transmission (16) that is shifted by the direction of rotation of the drive motor (10).

11 Claims, 4 Drawing Sheets

U.S. PATENT DOCUMENTS 5,752,871 A * 5/1998 Tsuzuki ..... 446/457
6,371,830 B1 * 4/2002 Wu et al. ..... 446/457
6,439,948 B1 * 8/2002 Ostendorff et al. ..... 446/154
6,843,749 B1 * 1/2005 Kelledes et al. ..... 475/224

* cited by examiner

TOY VEHICLE

FIELD OF INVENTION

The present invention relates to a toy vehicle and more particularly to a toy vehicle used in lane guided car racing, wherein the toy vehicle comprises a motor fitted with a drive shaft, a driven axle equipped with wheels, and a gear unit mounted between the drive shaft and the driven axle.

BACKGROUND ART

Illustratively and as regards autoracing in lanes, the object of a race is to move a toy vehicle manually as fast as possible over the tracks by controlling the vehicle's speed, without the vehicle thereby leaving the track in unwanted manner. Conventionally the toy vehicle is fitted with an electric motor longitudinally integrated in it, as well as a drive shaft projecting from one motor end and terminating in a gear unit. A pinion is mounted at the end of the drive shaft near the gear unit. The common axle of the powered wheels runs through the gear unit and is fitted with a crown gear. Inside the gear unit, the pinion meshes with the crown gear, different numbers of pinion teeth and crown gear teeth entailing different transmission ratios.

Moreover a steered toy vehicle is known form the German patent document A1 27 22 734 where, by engaging a clutch and by means of the direction of rotation of an electric motor, the vehicle's front steering is moved into the right or left end positions in order to move the toy vehicle from one side of the lane to the other. In order to drive the toy vehicle always in the same direction even though the direction of the electric motor is alternating, a cage is pivotably mounted on a drive shaft of the electric motor and encloses both a first pinion rigidly joined to the drive shaft and a second pinion engaging the first one. Depending on the direction of rotation of the electric motor, the cage each time pivots into a particular end position, the second pinion engaging a first crown gear and a second crown gear in a first end position, the two crown gears being mounted on one axle of driven wheels. In this configuration the driven-wheels axle is always powered in the same direction independently of the direction of rotation of the electric motor.

An object of the present invention is to improve to such an extent a toy vehicle of the above kind that even more realistic behavior of driving and steering shall be attained from the speed control means.

SUMMARY OF INVENTION

In accordance with the invention, a toy vehicle comprises a drive motor fitted with a drive shaft, a driven axle equipped with wheels, and a transmission unit between the drive shaft and the driven axle. The transmission unit includes two gears of different transmission ratios, a first gear being associated with a first direction of rotation of the drive motor and a second gear being associated with a second direction of rotation of the drive motor that is opposite the first direction of rotation.

Because the transmission unit is driven by the rotation direction of the motor, a gear shift device having different transmission ratios can be connected between the drive shaft and driven axle to provide a simple drive without additional switching elements. In this manner the toy vehicle acquires the additional function of gear shifting without entailing additional control elements. Gear shifting is illustratively provided by electrical commutation, frequency control of or phase shifting the vehicle potential, thus entailing reversal of the motor's direction of rotation.

Preferably the transmission unit includes first and second different gears, respectively associated with first and second opposite directions of motor rotation.

Appropriately the gear unit is designed in such a way that independently of the motor direction of rotation, the drive of the drive axle is always in the same direction.

In a preferred development of the present invention, the transmission unit comprises a mechanical barrier capable of assuming two positions and designed and configured in such manner that shifting the transmission unit is precluded when the drive motor direction of rotation is reversed in a first barrier end position, while in a second barrier end position shifting is unhampered. As a result reversing the drive motor direction of rotation selectively allows operating in forward and reverse motions or at different speeds/gears.

In an especially preferred embodiment of the present invention, the transmission unit comprises a first pinion non-rotatably affixed to the drive shaft, a cage which is rotatably joined to the drive shaft and which keeps a second pinion engaged with the first pinion and which, together with the second pinion, is pivotable about the drive shaft, acting as a pivot axis between the two end positions, further a first gear non-rotatably linked to the driven axle and a second gear non-rotatably linked to the driven axle, said first and second gears being fitted each with a different number of teeth and being configured in such a way that, in a first end position of said cage, the second pinion shall mesh with the first gear and in a second cage end position the second pinion shall mesh with the second gear. If a mechanical barrier is included, it will be designed in a way, when locked, to preclude the cage from pivoting.

The first and/or the second gears are illustratively crown gear(s).

The invention is described below in relation to the drawing.

Figure 2:
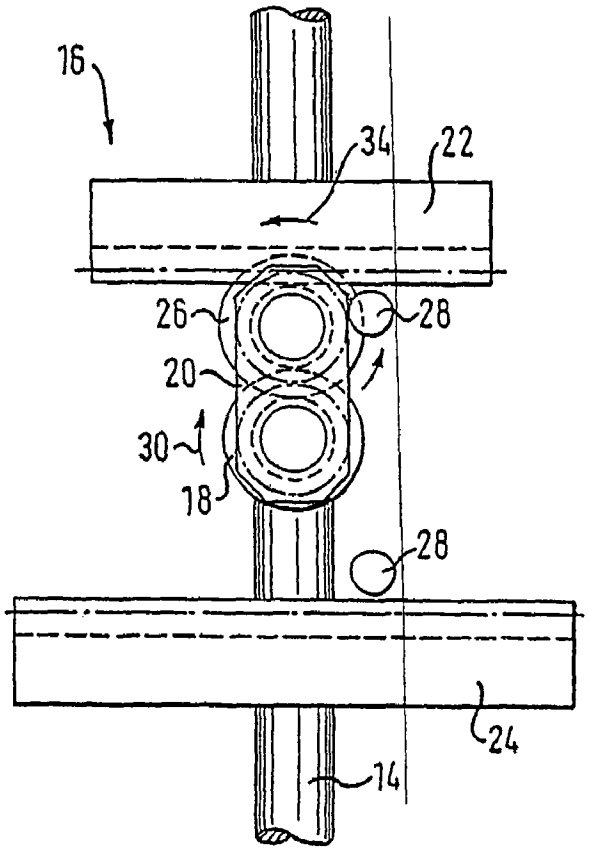
FIG. 2 is a sectional elevation view of the unit as illustrated in FIG. 1.

The preferred embodiment of a toy vehicle of the present invention shown merely in cutaway form in FIGS. 1 through 4 comprises a drive motor 10, a drive shaft 12, a driven axle 14 for wheels (not shown) and a transmission unit 16 mounted between the drive shaft 12 and the drive axle 14.

The transmission unit comprises a first pinion 18 rigidly affixed to the drive shaft 12, a cage 20 which is rotatably linked to the drive shaft 12, a first crown gear 22 non-rotatably mounted on the driven axle 14 and a second crown gear 24 non-rotatably mounted on the driven axle 21. The cage 20 encloses the first pinion 18 and additionally supports a second pinion 26 in such a way that said second pinion meshes with the first pinion 18.

Figure 4:
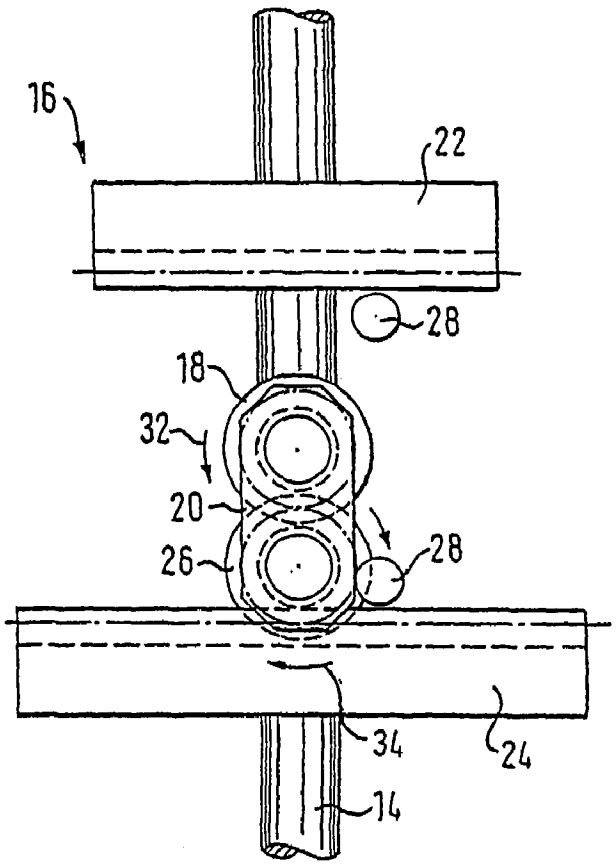
FIG. 4 is a sectional elevation view of the unit as illustrated in FIG. 3.
Figure 3:
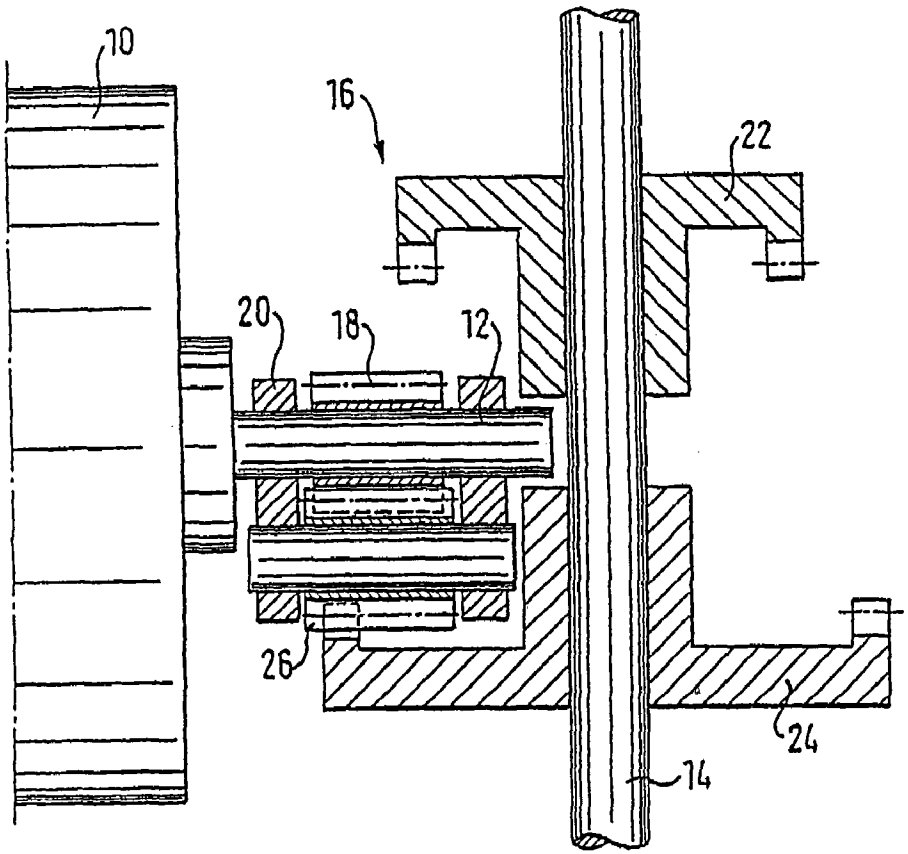
FIG. 3 is a topview of the preferred embodiment of the transmission unit of FIG. 1 in second gear.
Figure 6:
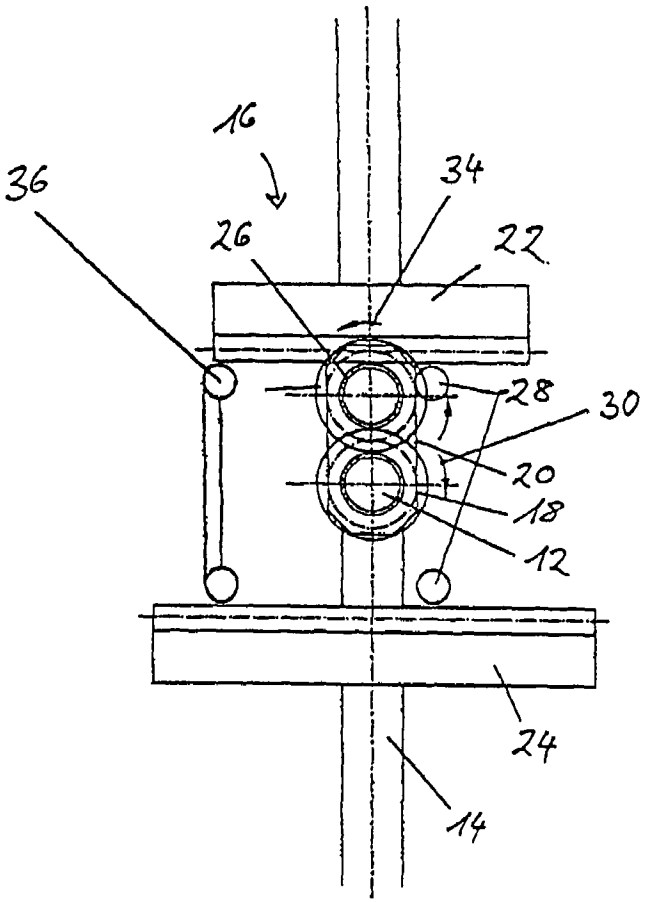
FIG. 6 is a sectional elevation view of the embodiment of FIG. 5, in first gear and with an unlocked barrier.

The cage 20 is designed and mounted in such a way that it can be pivoted jointly with the second pinion 26 about the drive shaft acting as the pivot axis between two end positions without the first and second pinions 18 and 26 disengaging from each other. In the end positions, the cage 20 rests against corresponding stops 28 (FIGS. 2 and 4). The two crown gears 22, 24 are configured in such manner that, in a first end position of the cage 20 shown in FIGS. 1 and 2, the second pinion 26 meshes with the first crown gear 22 and, in a second end position of the cage, such as shown in FIGS. 3 and 4, the second pinion 26 meshes with the second crown gear 24.

The crown gear 22 has fewer teeth than the second crown gear 24 and as a result different transmission ratios are operative in the two end positions of the cage 20 from the drive shaft 12 on the driven axle 14.

The rotational coupling between the drive shaft 12 and the cage 20 is arranged in such manner that when the direction of rotation of the drive shaft 12 is reversed, first the cage 20 rotates along with the drive shaft 12 until the cage 20 comes to rest against one of the stops 28. Because cage 20 remains in the particular end position while the drive shaft 12 continues rotating and presses the cage 20 against the particular stop 28, engagement assuring force transmission between the second pinion 26 and the particular crown gear 22 or 24 is established.

Figure 1:
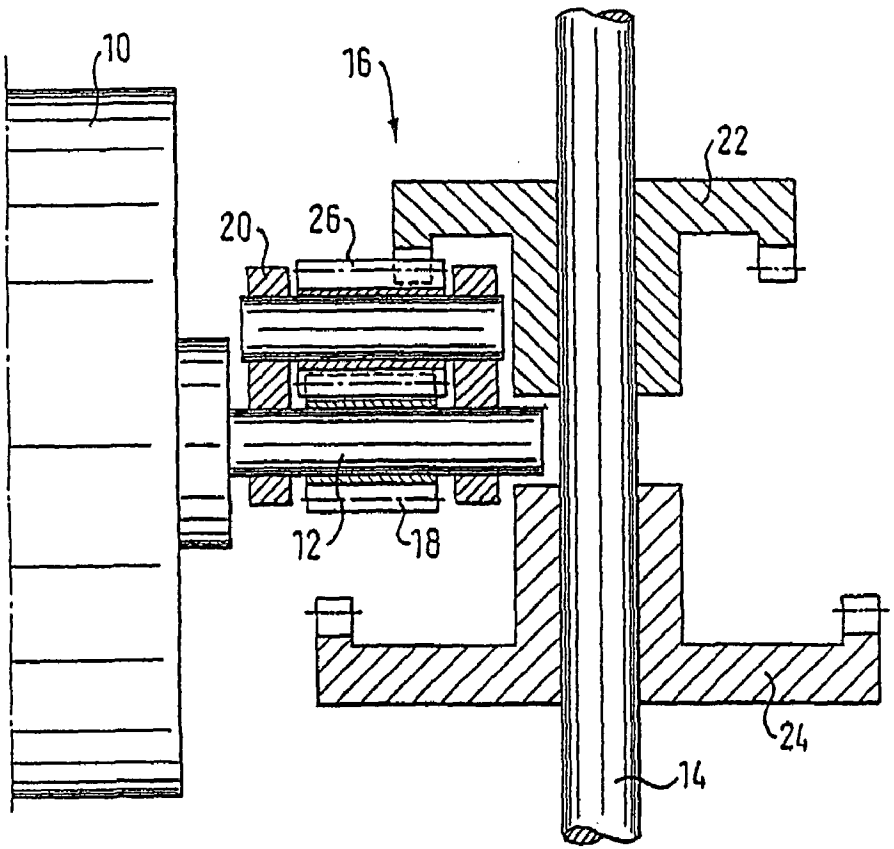
FIG. 1 is a topview of preferred embodiment of a transmission unit for a toy vehicle of the present invention in first gear.

FIGS. 1 and 2 show a situation wherein the drive shaft 12 together with the first pinion 18 rotates in the first direction denoted by the arrow 30. The cage 20 rests against the upper stop 28 of FIG. 2 and the second pinion 26 meshes with the first crown gear 22, as a result of which the axle 14 is driven in the direction of the arrow 34. In other words a first gear has been selected, entailing a corresponding transmission ratio from the drive motor 10 to the axle 14.

After the direction of rotation of the drive shaft 12 has been reversed in the direction of the arrow 32 in FIG. 4, the cage 20 pivots from the upper position shown in FIG. 1 into the lower position shown in FIG. 3, as a result of which the cage 20 now rests against the lower stop 28 of FIG. 4 and the second pinion 26 meshes with the second crown gear 24. Accordingly the second pinion 26 drives the driven axle 14 in the direction of the arrow 34 (FIG. 4). In other words, a second gear has been selected; the second gear providing a lower transmission ratio than the first gear. As shown by directly comparing FIGS. 2 and 4, even though the direction of rotation of the drive motor 10 has been reversed, the axle 14 is still driven in the same direction 34 for both selected gears.

Remarkably, transmission unit 16 does not require additional remote-controlled shifting elements. Instead of using an additional shifting element, shifting between gears is accomplished by reversing the direction of rotation of the drive motor 10.

Direct comparison of FIGS. 1 and 3 shows that the axial length of the second pinion 26 is such that, in spite of the different diameters of the first and second crown gears 22 and 24, the two end positions of the cage 20 provide reliable engagement between the second pinion 26 and the particular crown gear 22 or 24.

FIGS. 5 through 8 show a preferred further development of the present invention, where functionally identical components are denoted by the same reference numerals, said components already having been described above in relation to FIGS. 1 through 4. The embodiment of FIGS. 5 through 8 comprises an additional mechanical barrier 36, for selectively preventing pivoting of the cage 20 when the drive motor's direction of rotation is reversed. This arrangement enables the toy vehicle to move forward and backward. This mechanical barrier 36 is operated manually for instance.

Figure 5:
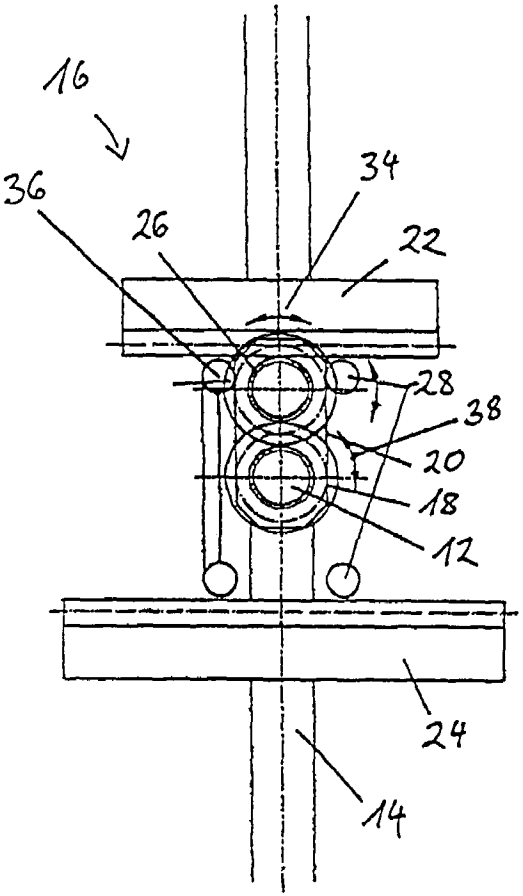
FIG. 5 is a sectional elevation view of an alternative embodiment of a transmission unit of a toy vehicle of the present invention in first gear and fitted with a mechanical barrier acting on the cage.
Figure 8:
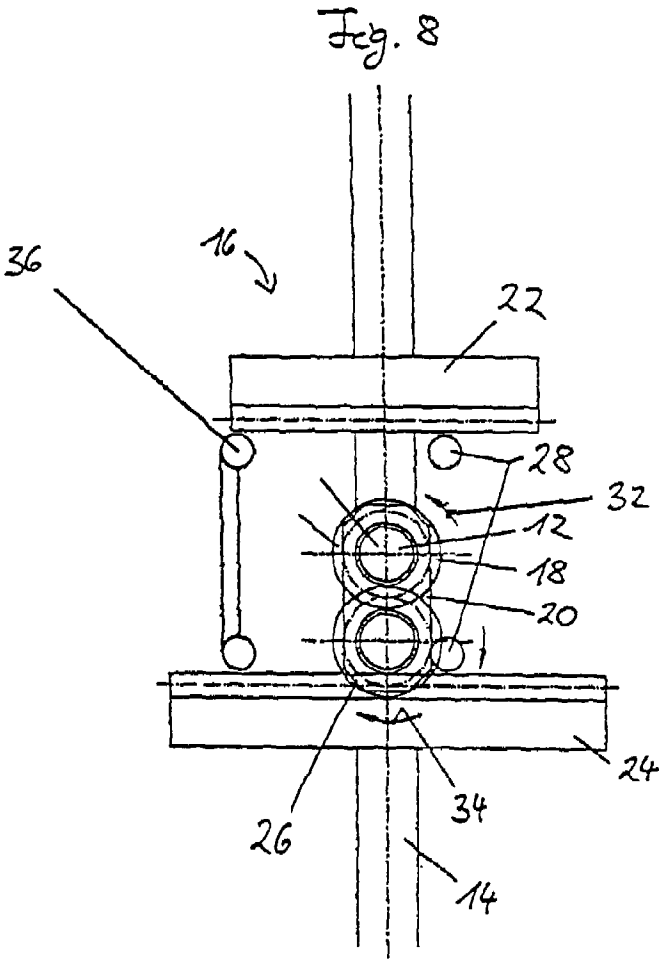
FIG. 8 is a sectional elevation view of the embodiment of FIG. 5 in second gear with an unlocked barrier.

FIG. 5 illustrates a case wherein the cage 20 assumes the "first gear" position (similar to the case of FIGS. 1 and 2) but the mechanical barrier 36 is locked to prevent cage 20 from pivoting. If the direction of rotation of the drive axle 12 is reversed in the manner indicated by the double arrow 38, the direction of rotation of the driven axle 14 reverses also, as denoted by the double arrow 34. According to the direction of rotation of the drive motor, therefore, the toy vehicle drives forward or backward, shifting from the first gear into the second gear being precluded by the mechanical barrier 36. The mechanical barrier 36 is unlocked in FIG. 6 and therefore the cage 20 again can be appropriately pivoted upon a change in the direction of rotation of the drive axle 12. Operation in first and second gears similar to that discussed above in relation to FIGS. 1 and 2 is then attained.

Figure 7:
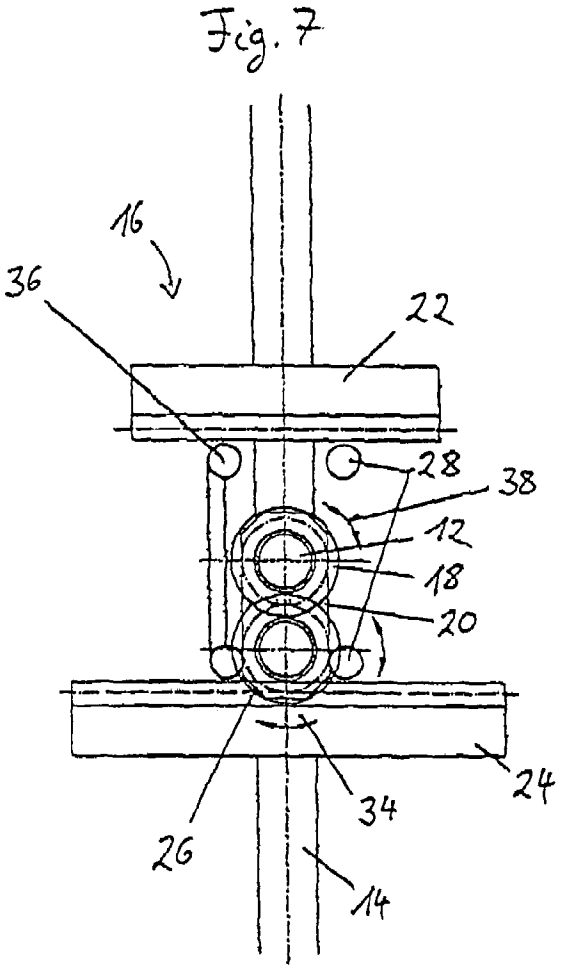
FIG. 7 is a sectional elevation view of the embodiment mode of FIG. 5, in second gear and fitted with the mechanical barrier for the cage.

FIG. 7 shows a case where the cage 20 is in the "second gear" position (similar to the case of FIGS. 3 and 4), but the mechanical barrier 36 is locked and hence the cage 20 is precluded from pivoting. If the direction of rotation of the drive axle 12 reverses, as indicated by the double arrow 38, the direction of rotation of the driven axle 14 also reverses, as denoted by the double arrow 34. Accordingly and depending on the direction of rotation of the drive motor, the toy car moves forward or backward while the mechanical barrier 36 prevents shifting from the second gear into the first gear. Because the mechanical barrier 36 is unlocked in FIG. 8 the cage 20 is again able to pivot according to reversals in the direction of rotation of the drive axle 12. In this latter case operation in the first and second gears takes place similarly to the above description relating to FIGS. 3 and 4.

The invention claimed is:

1. A toy vehicle comprising:

a drive motor fitted with a drive shaft and a driven axle equipped with wheels; and a transmission unit between the drive shaft and the driven axle, the transmission unit including first and second gears of different transmission ratios, the first gear being associated with a first direction of rotation of the drive motor, and the second gear being associated with a second direction of rotation of the drive motor that is opposite the first direction of rotation, wherein the transmission unit comprises:

a first pinion non-rotatably affixed to the drive shaft, and a cage rotatably coupled to the drive shaft, the cage keeping a second pinion engaged with the first pinion and jointly with the second pinion being pivotable about the shaft and forming a pivoting axis between two end positions, the first gear being non-rotatably joined to the driven axle, the first and second gears having different numbers of teeth and being configured so that in a first end position of the cage, the second pinion meshes with the first gear and, in a second end position of the cage, the second pinion meshes with the second gear.

2. A toy vehicle according to claim 1, wherein the transmission unit is arranged so that regardless of the direction of rotation of the drive motor, the drive of the driven axle is always driven in the same direction.

3. A toy vehicle according to claim 1, wherein the transmission unit comprises a two-position mechanical barrier which is arranged and configured so that in first and second positions of the mechanical barrier shifting of the transmission omit in response to reversal of the direction of the rotation of the drive motor is respectively precluded and unhampered.

4. A toy vehicle according to claim 1, wherein at least one of the first and second gears is a crown gear.

5. A toy vehicle according to claim 4, wherein a mechanical barrier is arranged and configured for preventing the cage from pivoting while it is in its first position.

6. A toy vehicle for track-guided motor racing tracks, comprising:

a drive motor having a drive shaft;

a driven axle having wheels; and a gearbox disposed between the drive shaft and the driven axle, said gearbox being arranged to change the speed of the driven axle, without changing the direction of rotation of the driven axle, in response to changing the rotation direction of the drive motor, the gearbox including a first gear arranged to be coupled between the drive shaft and the driven axle with a first gear ratio in response to a first rotation direction of the drive motor and a second gear arranged to be coupled between the drive shaft and the driven axle with a second gear ratio in response to a second rotation direction in opposition to the first rotation direction of the drive motor.

7. A toy vehicle according to claim 6, wherein the gearbox includes a mechanical block having a first position and a second position, wherein in the first position, switching of the gearbox upon changing the rotation direction of the drive motor is prevented, and in the second position, switching of the gearbox upon changing the rotation direction of the drive motor is possible.

8. A toy vehicle according to claim 6, wherein the gearbox is arranged to be pivoted in response to a change in the rotation direction of the drive motor, the gear box being arranged to be switched to another gear with a different gear ratio in response to the gearbox being pivoted.

9. A toy vehicle comprising:

a drive motor having a drive shaft;

a driven axle having wheels; and a gearbox disposed between the drive shaft and the driven axle, said gearbox being arranged to change the speed of the driven axle, in response to changing the rotation direction of the drive motor, the gearbox including a first gear arranged to be responsive to a first rotation direction of the drive motor and a second gear arranged to be responsive to a second rotation direction in opposition to the first rotation direction of the drive motor.

said gearbox comprising:

a first pinion non-rotatably linked to the drive shaft;

a cage rotatably linked to the drive shaft, said cage holding a second pinion in engagement with the first pinion and, together with the second pinion, being rotatable about the drive shaft as a pivot axis between two end positions; and a first toothed gear non-rotatably fixed to the driven axle and a second toothed gear non-rotatably fixed to the driven axle, said first and second toothed gears having different numbers of teeth and being arranged such that in a first end position of the cage, the second pinion meshes with the first toothed gear, and in a second end position of the cage, the second pinion meshes with the second toothed gear.

10. A toy vehicle according to claim 9, wherein at least one of the first gear and the second toothed gear is a crown gear.

11. A toy vehicle according to claim 10, wherein a mechanical block is arranged to prevent pivoting of the cage.

* * * * *

UNITED STATES PATENT AND TRADEMARK OFFICE

CERTIFICATE OF CORRECTION

PATENT NO. : 7,150,671 B2
APPLICATION NO. : 10/466064
DATED : December 19, 2006
INVENTOR(S) : Hubertus Maleika It is certified that error appears in the above-identified patent and that said Letters Patent is hereby corrected as shown below:

Cover page, Item (73) Assignee:

Please amend the Assignee as follows from "STADLBAUER SPIE-UND FREIZEITARTIKEL GMBH" to --STADLBAUER SPIEL-UND FREIZEITARTIKEL GmbH--.

Signed and Sealed this

Twentieth Day of March, 2007

JON W. DUDAS
*Director of the United States Patent and Trademark Office*